US008322448B2

(12) United States Patent
Brandsdal

(10) Patent No.: US 8,322,448 B2
(45) Date of Patent: Dec. 4, 2012

(54) DEVICE FOR PLUG REMOVAL

(75) Inventor: Viggo Brandsdal, Ytre Arna (NO)

(73) Assignee: TCO AS, Bergen (NO)

( * ) Notice: Subject to any disclaimer, the term of this patent is extended or adjusted under 35 U.S.C. 154(b) by 49 days.

(21) Appl. No.: 12/735,934

(22) PCT Filed: Mar. 6, 2009

(86) PCT No.: PCT/NO2009/000079

§ 371 (c)(1),
(2), (4) Date: Aug. 26, 2010

(87) PCT Pub. No.: WO2009/110805

PCT Pub. Date: Sep. 11, 2009

(65) Prior Publication Data

US 2011/0000663 A1 Jan. 6, 2011

(30) Foreign Application Priority Data

Mar. 6, 2008 (NO) ..... 20081192

(51) Int. Cl.
*E21B 29/00* (2006.01)

(52) U.S. Cl. ..... 166/376; 166/179; 166/164; 166/317

(58) Field of Classification Search ..... 166/178, 166/179, 285, 376, 153, 164, 317
See application file for complete search history.

(56) References Cited

U.S. PATENT DOCUMENTS 5,947,204 A * 9/1999 Barton ..... 166/317

* cited by examiner

*Primary Examiner* — Brad Harcourt

(74) *Attorney, Agent, or Firm* — Francis C. Hano; Carella, Byrne, et al.

(57) ABSTRACT

A device is described for removal of a plug which is used in a well, a pipe, or the like for carrying out tests, and it is characterized by an element which, with an applied forced, is arranged to penetrate into the plug material so that this is crushed, said element is arranged to be supplied said force from an above lying element. The element (16) is preferably a ring (1) the lower end of which is arranged to be forced in a radial direction into the plug element at axial driving of a hydraulic pressure piston. Furthermore, the element is integrated into the plug.

10 Claims, 4 Drawing Sheets

DEVICE FOR PLUG REMOVAL

The present invention relates to a device for removal of a plug that is used in a well, a pipe or the like for carrying out pressure tests, comprising a pipe casing in which the plug is mounted in a seat as described in the introduction to claim 1. The device which can also be a part of the plug construction itself comprises a crushing element.

In a well or a boring in a hydrocarbon-carrying formation, it is well known to close off all fluid passage in the well to test that all parts of the well are sufficiently leak proof and can hold a given fluid pressure before it is taken into use for production of hydrocarbons. For this purpose, a temporary plug of glass or a ceramic material is fitted in the well. Thereafter a fluid is forced up in the well to control that it is sufficiently leak proof.

When the testing is completed, the plug is removed, for example, by using explosive charges that are fitted onto or at the plug, or by crushing the plug mechanically.

Such explosive charges are often placed on the top of the plug, but they can also, in some cases, be placed in the centre of the plug. Many mechanisms are used to trigger such explosive charges.

In the known solutions, a plug is fitted into a pipe bundle which is inserted in a production pipe/pipe casing in the well that runs through an oil carrying/gas carrying formation. The explosive elements in the form of two column-shaped bodies are placed on top of the crushable plug which is made from glass, ceramics or the like.

The plug is inserted in the well so that pressure testing of the well can be conducted to control that all parts are sufficiently leak proof and can hold a given fluid pressure.

When these tests have been completed, the plug is removed by blowing it apart with the two explosive charges. The blowing apart can take place in many ways. A common way is that well fluid, at a given pressure, is let into the inner parts of the explosive charge housing so that an ignition pin is pushed down and strikes against the ignitor that starts the detonation of the explosive charge lying below. The glass is thus blown apart into a fine dust that causes no damage to the well. The elements themselves are also blown apart into small pieces. Explosives elements of this type leave behind many larger fragments in the fluid stream (described as debris) which are unwanted.

Today's system with explosive charges results in unwanted residues after these explosive charges and also the explosives represent a potential risk which is unwanted by the customers.

Also known are solutions where one can lower down a tool that crushes such plugs by a mechanical action, a blow or a boring and which thereby do not involve the use of explosives. It is also known to crush the plug elements by increasing the fluid pressure in the well until the plug is crushed.

Today this is a problem for the customers, also where the explosives lie inside the plug material. Although these risks are very theoretical, it is not acceptable to the customers.

With today's solution with several plug elements arranged on top of each other and fluid between the elements a corresponding crushing effect can also be obtained without the use of explosives.

This solution is based on that the controlled fluid between the plug elements can not be compressed and through this the upper plug element will have aid to take the axial load in the system from the below lying elements.

With this system one will be vulnerable to dropping things down into the well that can crush the upper plug element which alone does can not withstand a large mechanical load. The consequence of this will be that the plug can open at a point in time when it is very unfortunate. One is also vulnerable to any leaks of fluid out between the plug elements as this will also lead to opening of the plug before it is wanted.

It is also undesirable with such a solution, that to ensure that the plug breaks after the fluid between the elements has drained out in a controlled way one must have plug elements of such a thickness that they are crushed at moderate pressure. Glass, which is a relevant material, has a recommended safety factor of 3, something which can lead to that one, in unfortunate situations, does not get the plug crushed at the lower pressures one operates at after opening of the plug.

Another unfortunate factor is that one must pump up the pressure in the well after the opening system of the plug is activated, something that leads to a risk of damaging the reservoir when the plug collapses at higher pressure than the hydrostatic pressure in the well.

The plug device according to the invention is characterised by an element which, on being subjected to a force, is arranged to penetrate the plug material so that this ruptures, said element being arranged to be subjected to said force from an above-lying element.

The element is preferably a casing, the lower end of which is designed to be forced in a radial direction into the plug element by axial driving of a hydraulic pressure piston.

The lower end of the casing is shaped with a radially inwardly directed flange which under the actual influence of the piston moves radially in towards the plug element.

The pipe casing comprises a hollow space in which the ring casing with said flange is fitted.

The inner end of the flange forms a pointed tip of a considerably harder material than the plug element, such as, for example, a hard metal covering, ceramic covering or a diamond covering.

With the aid of the hydraulic pressure in the chamber the piston is arranged to move vertically on release and hit the casing at the top of the rear edge, and through its adapted shape force the casing with its pointed tip in to the plug element which is subsequently crushed. The casing and the piston are fitted in a boring(s) in a pipe casing which is fitted inside the plug pipe bundle, with the casing also defining the seat for the plug element.

The casing is further comprised of a release mechanism comprising a valve which on activation opens to let in pressure fluid to the channel and releases the piston, so that this moves axially downwards and "hits" the rear side of the casing.

Furthermore, the release mechanism of the device is arranged to "read/sense" pressure pulses in the pipe with the aid of mechanical, acoustic, electrical, ultrasound or hydraulic reading, and opens the valve on receiving the correct signal.

The plug has an area weakened in advance by minute cracks around its circumference, and which the flange edge with its pointed end hits when this is forced in towards the plug.

A number of slits can be cut out in the wall of the casing, these run axially from the lower edge of the casing and a distance up towards the upper edge. The casing is preferably shaped with two diametrically opposite slits, or a number of slits around the circumference, so that the lower part of the casing can be bent inwards, i.e. that each lower casing section between two adjoining slits can be bent inwards when the piston is exerting a pressure from the outside.

The plug is preferably made from a crushable material, such as glass or a ceramic material.

One can also remove the plug without the use of explosives.

This circular element is preferably fitted with a form of a claw at its lower part in towards the centre of the plug element, one can preferably have a hard metal, diamond or other harder material than the circular element claw fastened to the tip of the element claw, this hard metal tip of the claw will preferably dig into the plug material which will then be crushed.

When such a system with mechanical crushing is applied one avoids the problems of explosives and the safety risk this entails. One also avoids all remains after housings of the explosives in the well. This will represent an essential improvement to be able to deliver crushable plugs to all kinds of wells. Crushing from the side radially has been tested and gives very good results with glass and ceramic plugs. It is also essential that this occurs by crushing from the side as axial methods take up too much of the space and can reduce the active inner diameter of the pipe.

It will be a great advantage to get the explosive charges removed from today's systems and replace these with a system that can carry out the crushing mechanically.

Good effects are particularly obtained with glass when the sides around the circumference of the glass are ground so that they already contain minute cracks.

This is not problematic in relation to today's systems that have ground side surfaces on the glass which is used. A hammer element of hard metal or other essentially harder material which is driven into the sides of the glass will cause this to rupture in the minute cracks. If the glass is hardened, it will crush to small pieces or be pulverised such as the glass in a car window.

The system will also be much cheaper to produce, as one removes the expensive components represented by the explosives. Transport and logistics will also be much simplified.

The solution according to the invention functions in that the well pressure is released into a chamber with atmospheric pressure. As a consequence of the pressure, an axial mechanical movement is initiated which is transformed into a radial, mechanical movement which forces, with considerable power, the ring-shaped element and its pointed claw-shaped hard metal inner edge into the plug element. Then when the radial movement has started, the plug element breaks up in the minute cracks formed in the grinding process. As a consequence of the increased crack formation the hard metal on the claw has created, the plug will now collapse under the pressure from the well.

The piston has such a shape that it can be pushed into the rear side of the partially split casing that surrounds the plug element. The casing which the piston hits can be bent inwards at its lower end as a consequence of the partial splitting and will be forced in towards the centre of the plug element.

The movement of the piston can be released by either an electric signal, by ultrasound, by acoustic or hydraulic pulses in a well via a mechanical or electrical system.

The present solution also leads to a good solution with regard to a secure opening of the plug, as it does not contain explosives that can get lost. For users, this provides security as there is always a theoretical possibility with today's use of explosives that they can be left live in the well after use.

It is an aim of the invention to provide a solution where the plug is crushed without the aid of explosives and also to avoid the limitations, which today's solutions without explosives put on such things as thickness of the plug element and the danger of damage to the well formation at the opening of higher pressure than the hydrostatic pressure in the well.

Reference is made to the following figures, in which.

Figure 4:
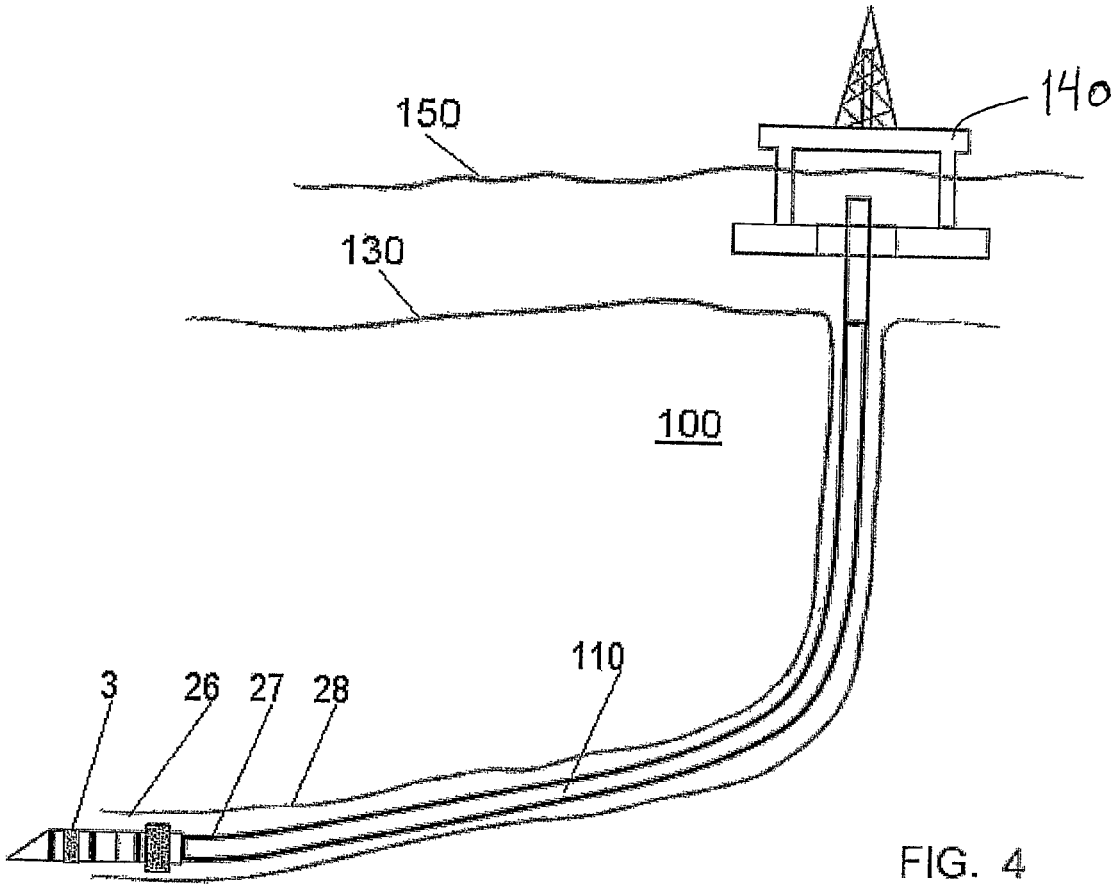

FIG. 4 shows a typical application area for such a test plug 25 which is fitted at the end of the pipe 27. Gaskets are shown between the pipes 27 and the casing pipe 38 in the well.

A PREFERRED EMBODIMENT

Figure 1:
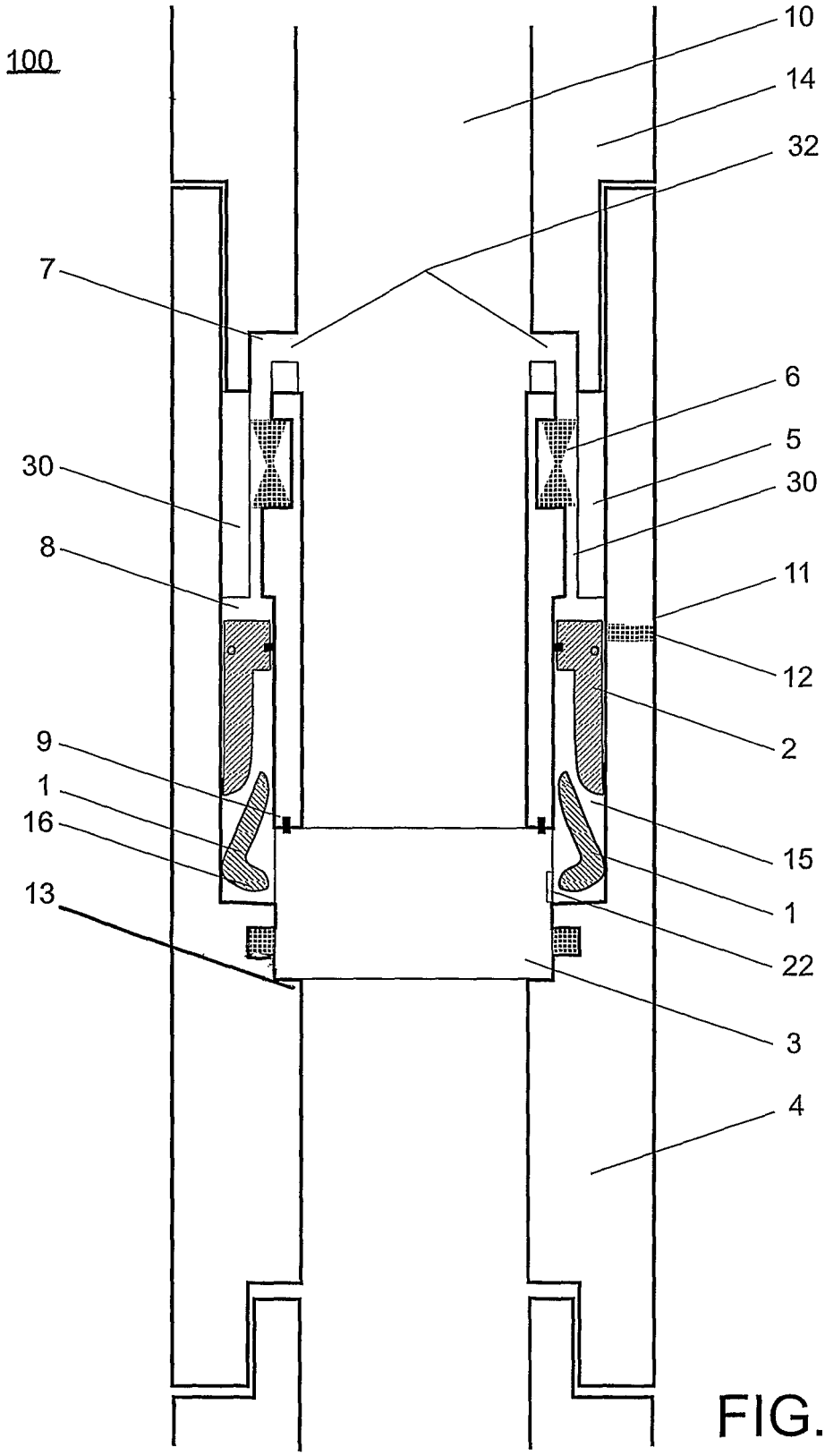
FIG. 1 shows the present invention in normal shut position where the plug is intact in its seat.

With reference to FIG. 1, a casing 4 is shown which is inserted, for example, into a production pipe 110 that runs through a formation 100. Reference number 10 shows the inside of the pipe which shall transport the hydrocarbons when the well begins production.

Plug casing 4 comprises a seat 13 where a plug 3 of a crushable material, such as glass, sits. The casing 4 further comprises an internal channel 30 (in a channel-forming part 5 of the main casing 4) with inlet opening 32 towards the pipe fluid 10. A valve 6 is inserted in the upper part of the channel 30 which initially is closed, but that can be opened for inflow of fluid with pressure from the pipe channel 10. The opening can occur by remote control as can be seen in the following. The lower part of the channel 30 forms an enlarged channel 8 in which a gliding piston 2 is fitted. In the present case, the piston 2 can be ring-shaped and run around the whole of the inside of the channel. The piston 2 has a cross section as a reversed L and its width is adapted to the breadth of the channel 8.

In the lower part of the channel 8 below the piston 2, a ring-shaped casing 1 is inserted in a narrow passage at the bottom of the channel 8, and such that the lower end 2*a* of the piston 2 lies partially between the outside of the casing 1 and the outer wall 33 of the channel 8.

Figure 3A:
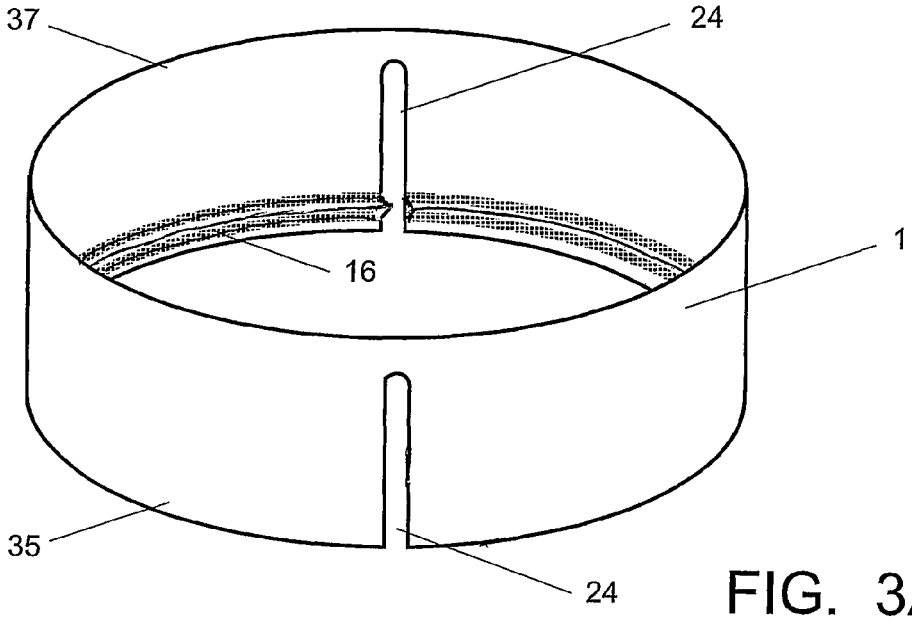
FIG. 3A shows a perspective outline of the inventive solution of the casing with two diametrically opposite vertical slits.
Figure 3B:
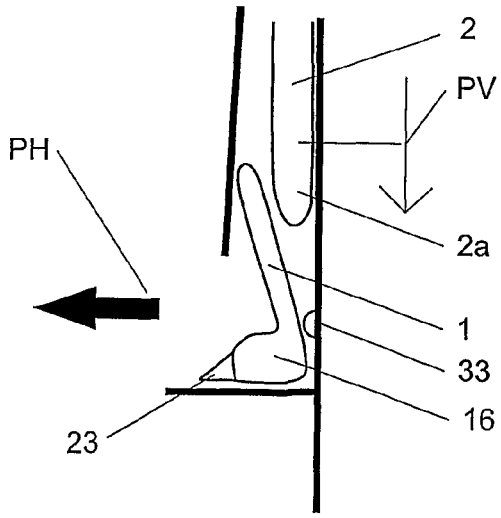
FIG. 3B shows a vertical section of the position of the piston 2 as it is forced downwards and pushes the lower part of the casing radially inwards.

The construction of the casing 1 is shown more clearly in FIG. 3A. A number of slits 24 are cut out in the casing wall and run axially from the lower edge 35 of the casing and some distance up towards the upper edge 37. The example shows two diametrically opposite slits, but several slits can be arranged around the circumference. At the lower edge 35, an inwardly extending flange 16 is arranged around the whole of the circumference of the casing. The flange 16 has an appointed end 23 (as a claw) in the radially inward direction. This is shown more clearly in FIG. 3B. As a consequence of the slits 24 and the narrow passage of the casing in the channel 8, the lower part of the casing can be bent in the inward direction.

When the piston 2 is forced vertically downwards (see the arrow Pv) as a consequence of the fluid pressure from the above through the channel, the piston is wedged in between the casing 1 and the wall 33 and the pointed end 23 (the claw) hits (see the arrow Ph) in towards the glass plug 3 lying radially inside.

Figure 2:
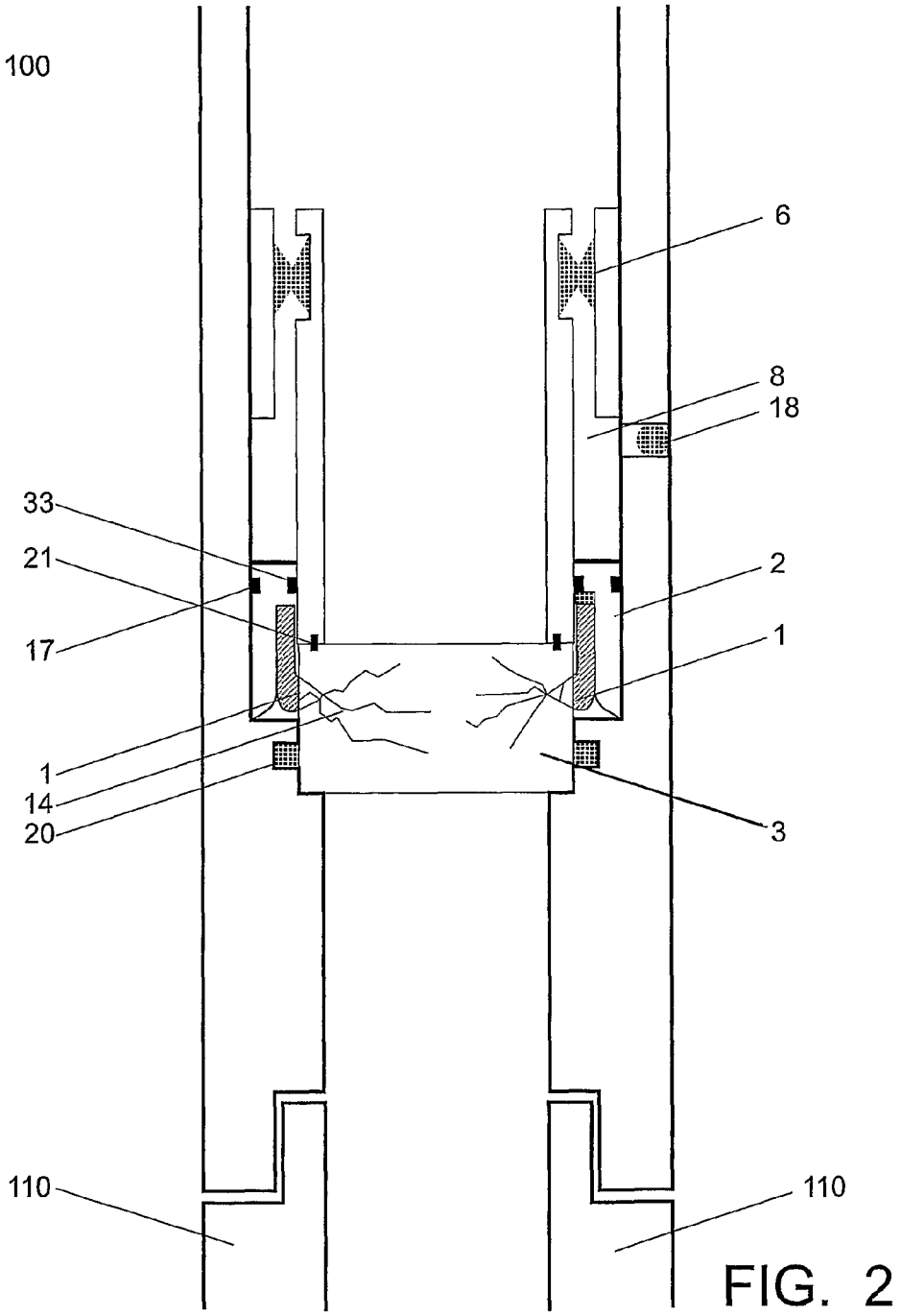
FIG. 2 shows the present invention where the element is about to hit/be moved radially into the plug element and reinforce the crack formation so that the plug collapses.

The glass plug 3 is shaped or polished with a so called "slip" around the circumference to form minute cracks into the glass material. When the claw 23, as shown in FIG. 2, hits into the plug, the minute cracks spread into the glass which thereby dissolves and is pulverised.

FIG. 4 shows a typical application area for such a test plug 25 which is fitted at the end of the pipe 27. The formation which the pipe/the well runs through and which is to be tested, is shown by 100. The seabed is shown by 130, the sea surface by 150 and the installation in the form of a platform which drives the production is shown schematically by 140.

Description of a Method

The piston 2 is held in place in the upper part of the casing 5 by a shear pin 11. The casing 5 also holds the plug element 3 in the seat 13. The casing 5 is held in place by a nut 14.

The lower part of the casing 5 lies just above the casing ring 1, with slits, that has the claw 16 at its lower end, the claw 16 has a hard metal tip 23, the ring 1 with claw 16 and hard metal tip 23 is fitted in a ring room 15 which is adapted to the piston 2.

The claw 16 and hard metal tip 23 are forced into the plug element 3 in that the piston 2 is subjected to a hydraulic pressure in through the activation valve 6 and hits the top of the ring 1. The ring 1 is then compressed and is forced into the plug element 3 in that the piston 2 takes up the space in the annular space 15 in which the ring 1 is mounted.

The piston 2 is shaped such that it hits the outside of the casing 1, with slits, and can thereby force this inwards to the centre of the plug element 3.

The downward travelling axial movement of the piston 2 takes place as a consequence of the annular space 15 being pressurised atmospherically and that the piston 2 is given a hydrostatic pressure from the top of the well when the valve 6 in the channel 30 in the opening system opens. Thereby, one provides a large differential pressure to the piston 2 and through this enough force to make the ring 1 with its claw 16 penetrate the plug element 3.

The valve 6 of the opening element is a device of the type which senses pressure pulses in the well applied from the top side of the plug element 1. This valve will then open for the pressure after having received the correct pressure pulses applied to the top of the plug element 1. This signal, which makes the valve 6 open for inflow of fluid, can be an electrical, mechanical, hydraulic, acoustic or ultrasound signal.

The piston 2 comprises a sealing element 17 and 33 to provide pressure integrity in the chamber 8. Shear pins 11 fitted in a hole 12 have a plug 18 fitted to create pressure in the chamber 8. The nut 14 comprises through-going holes to let in well pressure to the valve 6. The casing 5 also comprises sealing bodies 20 and 21 to obtain pressure integrity in the chamber 15. The sealing element 20 also has as a main task to retain the pressure from the well side 24 of the plug element 3.

When the piston 2 is released to the downward movement with the aid of pressure in through the valve 6, the claw 16 with the hard metal tip 23 is forced into the plug element 3.

The hard metal tip 23 on the claw 16 hits a point or area 23 of the plug element 3 which is weakened in advance. The weakened area 22 of the plug element 3 comprises minute cracks and one can thereby, to a considerable extent, reduce the force which is necessary to crush the plug element 3.

According to the invention, it is preferred (most practical) that the piston 2 gets its force from the well pressure above the internal space 10, but one can also imagine that a compressed spring can be used to drive the piston downwards. It will also be possible to use, for example, a cartridge with compressed gas which is released by remote control.

According to an alternative solution, the piston 2 can be arranged horizontally in the casing 5, but one can also imagine that one has several borings for many pistons that influence several separate inwardly facing claws instead of a circular ring with a ring-shaped claw at its lower end. These imagined pistons can be moved inwards or outwards from the centre line of the plug 3 according to need.

With the present invention, a considerable technical advance is made in the area that relates to test plugs made from a disintegrateable/crushable material.

The invention claimed is:

1. A device for removing a plug in a production pipe comprising a plug casing for positioning in a pipe, said casing having an annular seat for receiving a plug of crushable material thereon;

a ring-shaped casing disposed concentrically within said plug casing and having a plurality of axially disposed slits extending upwardly from a lower edge thereof and a radially inward extending flange at a lower end thereof for surrounding a plug of crushable material on said seat of said plug casing; and a piston within said plug casing for engaging and moving said flange of said ring-shaped casing radially inwardly in response to an axial movement of said piston relative to said ring-shaped casing whereby said flange of said ring-shaped casing is able engage and penetrate a plug of crushable material on said seat of said plug casing to cause crushing thereof.

2. A device as set forth in claim 1 wherein said plug casing has a hollow space receiving said ring-shaped casing in fitted relation.

3. A device as set forth in claim 1 wherein said flange forms a pointed tip selected from one of a hard metal covering, a ceramic covering and a diamond covering.

4. A device as set forth in claim 3 wherein said piston is disposed to move vertically to engage said ring-shaped casing at a top rear edge to force said pointed tip radially inwardly.

5. A device as set forth in claim 1 wherein said plug casing has a central pipe channel for a flow of fluid and an annular channel therein receiving said piston and said ring-shaped casing, said annular channel being in communication with said central pipe channel to receive fluid therefrom.

6. A device as set forth in claim 5 further comprising a valve in said annular channel for opening said annular channel to said central pipe channel to allow fluid to communicate with said piston.

7. A device as set forth in claim 6 further comprising a release mechanism for sensing pressure pulses in said central pipe channel and opening said valve in response to predetermined pressure pulses.

8. A device for removing a plug in a production pipe comprising a plug casing for positioning in a pipe, said casing having an annular seat;

a plug of crushable material seated on said seat of said plug casing;

a ring-shaped casing disposed concentrically within said plug casing and about said plug, said ring-shaped casing having a plurality of axially disposed slits extending upwardly from a lower edge thereof and a radially inward extending flange at a lower end thereof surrounding said plug of crushable material; and a piston within said plug casing for engaging and moving said flange of said ring-shaped casing radially inwardly in response to an axial movement of said piston relative to said ring-shaped casing whereby said flange of said ring-shaped casing is able engage and penetrate said plug of crushable material to cause crushing thereof.

9. A device as set forth in claim 8 wherein said plug has a weakened area having minute cracks therein facing said flange of said ring-shaped casing.

10. A device as set forth in claim 8 wherein said plug is made of one of glass and ceramic.

* * * * *

UNITED STATES PATENT AND TRADEMARK OFFICE

CERTIFICATE OF CORRECTION

PATENT NO. : 8,322,448 B2
APPLICATION NO. : 12/735934
DATED : December 4, 2012
INVENTOR(S) : Viggo Brandsdal It is certified that error appears in the above-identified patent and that said Letters Patent is hereby corrected as shown below:

Column 6, line 58, change “able” to --able to--

Signed and Sealed this
Twenty-second Day of January, 2013

David J. Kappos

David J. Kappos
*Director of the United States Patent and Trademark Office*